US006267523B1

(12) United States Patent
Poels et al.

(10) Patent No.: US 6,267,523 B1
(45) Date of Patent: Jul. 31, 2001

(54) INK PEN REFILL WITH DIVERSELY COLORED GEL INK LAYERS AND METHOD OF MANUFACTURE

(75) Inventors: Edward John Poels, Bel Air, MD (US); Sin-Hwa Huang, Taipei (TW)

(73) Assignee: Raymond Geddes & Company, Inc., MD (US)

( * ) Notice: Subject to any disclaimer, the term of this patent is extended or adjusted under 35 U.S.C. 154(b) by 0 days.

(21) Appl. No.: 09/633,250

(22) Filed: Aug. 4, 2000

(51) Int. Cl.[7] ..... A46B 11/00

(52) U.S. Cl. ..... 401/16; 401/141; 401/142; 401/222

(58) Field of Search ..... 401/16, 141, 142, 401/23, 195, 198, 34, 44, 47, 222

(56) References Cited

U.S. PATENT DOCUMENTS 5,306,092 * 4/1994 Jenq ..... 401/47
5,971,643 * 10/1999 Ahmed ..... 401/44

* cited by examiner

*Primary Examiner*—David Walczak
(74) *Attorney, Agent, or Firm*—H. Jay Spiegel

(57) ABSTRACT

An ink pen refill consists of a single writing point connected to an elongated barrel in which gel ink is stored in distinctly colored layers. At the proximal end of the barrel, just behind the most proximal color band of ink, a quantity of grease is inserted in the barrel to seal the ink within the barrel. In manufacturing the ink pen refill, after installing the elongated barrel on the proximal end of the writing point, a quantity of gel ink of a first particular color is inserted within the barrel just proximal of the writing point using a filling pipe. When the desired quantity of ink has been so inserted, the elongated barrel with the writing point is placed in a centrifuge and is centrifuged to remove any air bubbles contained within the ink. Next, the next color of gel ink is dispensed into the barrel just proximal of the first layer of ink. The entire refill is again centrifuged to remove any bubbles from the newest layer of ink. This process is repeated over and over again until each of the layers of gel ink have been dispensed into the elongated barrel. When the last color has been dispensed, a layer of grease is inserted at the proximal end of the barrel to seal the ink layers in place. In an alternative method, one may fill the elongated barrel with a multiplicity of diverse colors by filling two or more colors for each centrifuging operation.

25 Claims, 1 Drawing Sheet

INK PEN REFILL WITH DIVERSELY COLORED GEL INK LAYERS AND METHOD OF MANUFACTURE

BACKGROUND OF THE INVENTION

Gel inks have become quite popular for use in writing pens. In particular, gel inks may be made in pastel, neon and metallic colors that shine brightly from a piece of paper when used to write.

Ink pens employing pastel, neon or metallic colored gel ink are typically made with a single color of gel ink in the barrel of the refill.

Children need to be encouraged to learn to write and to use an ink pen in writing. The present invention encourages children to write with an ink pen because they are anxious to see the ink within the pen change colors as writing takes place.

SUMMARY OF THE INVENTION

The present invention relates to an ink pen refill with diversely colored gel ink layers and method of manufacture. The present invention includes the following interrelated objects, aspects and features:

(1) In a first aspect, the inventive ink pen refill consists of a single writing point such as, for example, a roller ball. Of course, other types of writing points may be employed. The writing point is connected to an elongated barrel in which the ink is stored.

(2) In the preferred embodiment of the present invention, the ink that is stored in the barrel consists of a gel ink. The gel ink is stored in the barrel in distinctly colored layers. Thus, for example, in a single elongated barrel, gel ink having consecutive colors, for example, yellow, orange, green, pink, blue and violet may be placed. The writing point is located at the distal end of the barrel. At the proximal end, just behind the most proximal color band of ink, a quantity of grease is inserted in the barrel to seal the ink therewithin. In the preferred embodiment, the grease is made of a material such as, for example, silicone grease or polybuden grease.

(3) In manufacturing the ink pen refill, after installing the elongated barrel on the proximal end of the writing point, a quantity of gel ink of a first particular color such as, for example, yellow is inserted within the barrel just proximal of the writing point using a filling pipe. When the desired quantity of yellow ink, for example, has been so inserted within the elongated barrel, the elongated barrel with the writing point affixed thereto is placed in a centrifuge and is centrifuged at a rotation speed of 700 to 900 rpms for a period of 50 to 70 seconds. During the centrifuging, any air bubbles contained within the ink are removed.

(4) Next, the next color of gel ink is dispensed into the barrel just proximal of the yellow ink using a filling pipe. After the desired quantity of ink has been dispensed into the elongated barrel, the entire refill with the writing point, elongated barrel, yellow ink layer, and new ink layer, for example, in an orange color, is placed in the centrifuge and the refill is centrifuged within the same speed range and for the same time duration described hereinabove to remove any bubbles from the newest layer of ink.

(5) This process is repeated over and over again until each of the six or more layers of uniquely colored gel ink have been dispensed into the elongated barrel. When the last color has been dispensed therein, a layer of grease, preferably silicone grease or polybuden grease, is inserted at the proximal end of the barrel to seal the ink layers in place.

(6) In order for the inventive process to work effectively, each of the gel ink layers is made of an ink having a specific gravity substantially the same as the specific gravities of the other layers. When this is the case, the ink layers will not intermix and bleed into one another as the filling process is conducted as described above.

(7) In an alternative method, one may fill the elongated barrel with a multiplicity of diverse colors by filling two colors for each centrifuging operation. Thus, for example, a filling pipe is employed to fill a quantity of yellow ink followed by a substantially equal quantity of orange ink. Once these two colors have been dispensed into the elongated barrel, they are centrifuged. The result is a single mixed color having aesthetically pleasing striations and marbling evidencing the existence of two separate colors therein.

Accordingly, it is a first object of the present invention to provide an ink pen refill with diversely colored gel ink layers.

It is a further object of the present invention to provide a method of manufacturing such an ink pen refill.

It is a still further object of the present invention to W provide such a refill having a multiplicity of diversely colored gel ink layers with a grease layer retaining the gel ink layers in place within the elongated barrel.

It is a still further object of the present invention to provide such a refill in which two colors are filled into the elongated barrel thereof for each centrifuging operation.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
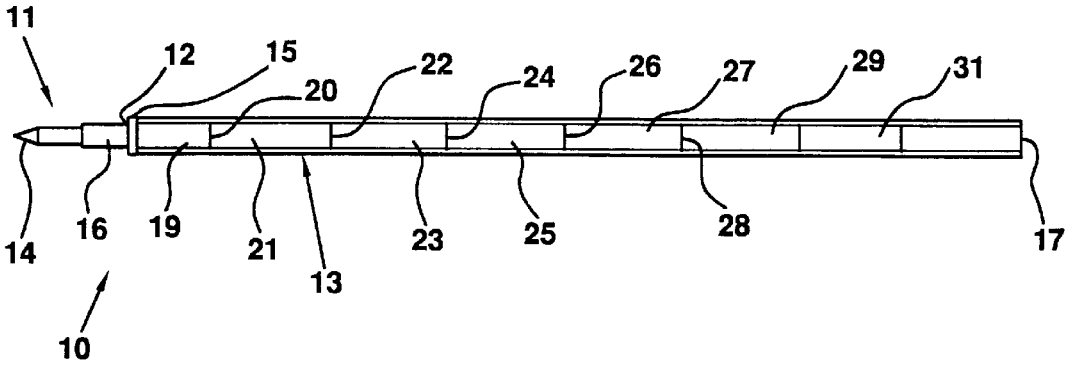
FIG. 1 shows a side schematic view of an ink pen refill in accordance with the teachings of the present invention.

With reference, first, to FIG. 1, the inventive ink pen refill is generally designated by the reference numeral 10 and is seen to include a writing point 11 having a top 14 and an elongated, preferably cylindrical, barrel 13 affixed to the proximal end 12 of the writing point 11 in any suitable manner such as is well known to those skilled in the art. Of course, the barrel can have any desired cross-section. The elongated barrel 13 includes a distal end 15 which receives adaptor 16 and a proximal end 17 that is open in the proximal direction.

As is seen in FIG. 1, the barrel 13 is filled with a plurality of different layers of inks of differing colors. Thus, for example in the distal to proximal direction, the barrel 13 includes distinct layers of ink 19 (yellow), 21 (orange), 23 (pink), 25 (green), 27 (blue), and 29 (violet). Any desired plurality of layers may be employed.

Of course, this arrangement of colors is merely exemplary. Any desired colors of ink may be employed and the order of their insertion within the elongated barrel 13 may be as desired.

Each color layer is separated at what is shown in FIG. 1 to be a crisp linear dividing line. Thus, for example, the layers 19 and 21 are separated by a crisp dividing line 20. Similarly, the layers 21 and 23 are separated by a crisp dividing or transition line 22. A crisp dividing line 24 separates the layers 23 and 25. A dividing line 26 separates the layers 25 and 27. Finally, a dividing line 28 separates the layers 27 and 29.

Proximal of the layer 29, a layer of grease 31 is provided which holds all of the layers of ink within the barrel 13. In the preferred embodiment, the grease 31 comprises silicone grease or polybuden grease.

As an important aspect of the present invention, to best maintain the separation of the different layers of ink into distinct layers with the distinct dividing lines, the specific gravities and the viscosities of the respective layers should be the same to within one or two percent.

As is known to those skilled in the art, gel inks are also manufactured in metallic colors that have a higher specific gravity than the specific gravity of pastel colors of such inks. Where the manufacturer wishes to use a metallic color of gel ink for one of the layers, Applicants have found that locating the metallic gel ink layer closest to the writing point 11 provides the best assurance that the different layers of colored gel ink will not bleed into one another within the elongated barrel 13. Thus, for example, the layer of ink 19 may comprise a silver layer.

In an alternative, that will be described in greater detail hereinafter with regard to the inventive method, two or more colors may be combined together in a single band. Thus, for example, during the course of manufacture, as will be described in greater detail hereinafter, the yellow and orange layers 19 and 21, respectively, may be mixed together within the barrel to provide interesting artistic patterns striations and marbling that enhance the aesthetic appearance of the pen.

Figure 2:
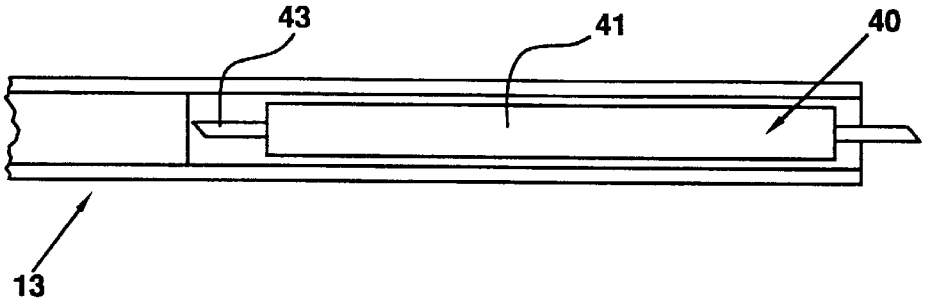
FIG. 2 shows an enlarged side view of the refill with a filling pipe inserted therein to fill the elongated barrel thereof with ink.

In the inventive method of making the ink pen refill 10, reference is now made to FIG. 2 which shows the barrel 13 with a filling pipe 40 inserted therein. The filling pipe 40 includes a reservoir 41 and a hollow needle 43 through which ink contained within the reservoir 41 may be dispensed in a manner well known to those skilled in the art. Filling pipes such as the filling pipe 40 are employed in practicing the inventive method.

In making a refill such as the refill 10 shown in FIG. 1, first, ink of a first color such as, for example, yellow, is inserted within a filling pipe such as the filling pipe 40. Thereafter, the filling pipe 40 is inserted deeply into the elongated barrel 13 until it is just adjacent the distal end 15 thereof. Thereafter, the yellow ink layer 19 is dispensed from the filling pipe 40 via the needle 43 into the elongated barrel 13 until the desired amount of yellow (for example) ink has been dispensed.

Thereafter, the entire refill 10 is placed vertically within a centrifuge device (not shown) and is rotated at a speed of from 700 to 900 rpms for a period of from 50 to 70 seconds. During the centrifuging step, any air bubbles contained within the ink layer 19 are removed.

Thereafter, a filling pipe 40 containing the next color of ink, for example, orange ink, is inserted within the elongated barrel 13 to just proximal of the ink layer 19 and the ink is dispensed so that a layer 21 of orange ink of a desired thickness has been inserted. Thereafter, the entire refill 10 is again placed vertically within a centrifuge apparatus and is rotated at a speed of from 700 to 900 rpms for a duration of from 50 to 70 seconds. This centrifuging removes any bubbles that may be contained within the layer of orange ink 21. A dividing line 20 between the yellow and orange ink layers (FIG. 1) is maintained during the centrifuging and Applicants have found that there is minimal bleeding of ink between the respective layers thereof. So long as the specific gravities of the respective layers of ink are maintained substantially the same, this phenomenon may be maintained. The gel inks employed also, preferably, have substantially equal viscosities.

The process is repeated step after step as described above until each of the layers 21, 23, 25, 27 and 29 has been sequentially dispensed into the elongated barrel 13 including the centrifuging steps to remove air bubbles after each dispensing of a colored ink in a layer within the barrel 13.

When the last color layer of ink has been dispensed within the barrel 13, a layer of grease, preferably silicone grease or polybuden grease, designated by the reference numeral 31 in FIG. 1 is inserted behind the layer 29 of ink to seal all of the layers of ink within the barrel 13. Thereafter, the refill 10 is ready for use.

As an alternative to the inventive method described above, two or more layers of ink may be inserted within the barrel 13 before each centrifuging step. For example, the yellow layer 19 of ink and the orange layer 21 of ink may be consecutively dispensed within the elongated barrel as shown in FIG. 1. After the orange layer 21 has been dispensed therein, the centrifuging step may be carried out to not only remove air bubbles but to mix the yellow and orange layers of ink together. Based upon the properties of gel ink, when the yellow and orange layers are centrifuged together, certain striations and marbling occur within the mixed ink which provide an aesthetic appearance that is quite attractive.

As mentioned above, it is preferable that each layer of ink have a specific gravity substantially equal, within one or two percent, to the specific gravities of the other layers. As a result, this prevents blurring of the dividing lines between adjacent layers. Applicants have found, however, that the first layer of ink may, if desired, have a specific gravity higher than the specific gravities of the other layers. Gel inks are well known for being manufactured in colors including metallic colors such as silver. Such metallic gel inks have higher specific gravities than other pastel colors for such inks. If a metallic color is provided for the first layer of ink at the most distal end of the elongated barrel 13, the higher specific gravity thereof will not result in mixing with the adjacent layer. So long as the more proximal layers of ink have the lower specific gravity and specific gravities similar to one another, a higher specific gravity of metallic ink layer may be employed at the location of reference numeral 19 in FIG. 1.

As such, an invention has been disclosed in terms of an apparatus and method of manufacture that fulfill each and every one of the objects of the invention as set forth hereinabove and provide a new and useful ink pen refill with diversely colored gel ink layers and method of manufacture.

Of course, various changes, modifications and alterations in the teachings of the present invention may be contemplated by those skilled in the art without departing from the intended spirit and scope thereof.

As such, it is intended that the present invention only be limited by the terms of the appended claims.

What is claimed is:

1. An ink pen refill, comprising:

a) a writing point having a proximal end to which is attached an elongated barrel having an axis of elongation;

b) said elongated barrel having an ink reservoir;

c) said reservoir being fluidly connected to said writing point, said writing point receiving ink from said reservoir and said writing point being adapted to dispense said ink;

d) said ink being contained within said reservoir in a plurality of layers of ink, each layer having a distinct single color or a pattern caused by mixing of plural colors within a said layer, and adjacent layers being separated by a distinct dividing line generally perpendicular to said axis of elongation.

2. The refill of claim 1, wherein all of said layers of ink have a substantially equal specific gravity.

3. The refill of claim 1, wherein at least one layer of ink consists of at least two separate colors mixed together.

4. The refill of claim 1, wherein said ink comprises gel ink.

5. The refill of claim 1, wherein just proximal of a most proximal layer of ink, a layer of grease is located within said reservoir to seal said layers of ink therein.

6. The refill of claim 5, wherein said grease is chosen from the group consisting of silicone grease and polybuden grease.

7. The refill of claim 1, wherein said barrel is cylindrical.

8. The refill of claim 1, wherein a most distal layer of ink has a first specific gravity and layers of ink proximal to said most distal layer of ink have a substantially equal larger specific gravity.

9. The refill of claim 1, wherein a most proximal layer of ink has a silver color.

10. A method of making an ink pen refill, including the steps of:

a) providing a refill having a writing point with a proximal end to which is attached an elongated barrel, said barrel having an ink reservoir fluidly connected to said writing point;

b) dispensing a first layer of ink into said reservoir;

c) centrifuging said refill to remove air bubbles from said first color ink;

d) dispensing a second layer of ink into said reservoir; and e) centrifuging said refill to remove air bubbles from said second color ink;

f) said first and second layers of ink having diverse colors or patterns.

11. The method of claim 10, wherein said centrifuging steps consist of centrifuging said refill for a period of 50 to 70 seconds at a speed of 700 to 900 rpms.

12. The method of claim 10, wherein said first and second layers of ink have a substantially equal specific gravity.

13. The method of claim 10, wherein said first layer of ink has a higher specific gravity than that of said second layer of ink.

14. The method of claim 13, wherein said first layer of ink has a silver color.

15. The method of claim 10, further including the step of, after said second centrifuging step, inserting a layer of grease into said reservoir.

16. The method of claim 15, wherein said grease is chosen from the group consisting of silicone grease and polybuden grease.

17. A method of making an ink pen refill, including the steps of:

a) providing a refill having a writing point with a proximal end to which is attached an elongated barrel, said barrel having an ink reservoir fluidly connected to said writing point;

b) dispensing a first color ink into said reservoir;

c) dispensing a second color ink into said reservoir;

d) centrifuging said refill to mix said first and second color inks together and remove air bubbles therefrom; and e) dispensing a third color ink into said reservoir;

f) centrifuging said refill to remove air bubbles from said third color ink.

18. The method of claim 17, wherein said centrifuging steps consist of centrifuging said refill for a period of 50 to 70 seconds at a speed of 700 to 900 rpms.

19. The method of claim 17, wherein said first and second color inks have a substantially equal specific gravity.

20. The method of claim 17, further including the step of, after said second centrifuging step, inserting a layer of grease into said reservoir.

21. An ink pen refill, comprising:

a) an elongated barrel having an axis of elongation;

b) a writing point attached to an end of said barrel;

c) said elongated barrel having an ink reservoir;

d) said reservior being fluidly connected to said writing point, said writing point receiving ink from said reservior and said writing point being adapted to dispense said ink;

e) said ink being contained within said reservoir in a plurality of layers of ink, each layer having a distinct single color or a pattern caused by mixing of plural colors within a said layer, and adjacent layers being separated by a distinct dividing line generally perpendicular to said axis of elongation.

22. A method of making an ink pen refill, including the steps of:

a) providing a refill having an elongated barrel to which is attached a writing point, said barrel having an ink reservoir fluidly connected to said writing point;

b) dispensing a first layer of ink into said reservoir;

c) centrifuging said refill to remove air bubbles from said first color ink;

d) dispensing a second layer of ink into said reservoir; and e) centrifuging said refill to remove air bubbles from said second color ink;

f) said first and second layers of ink having diverse colors or patterns.

23. A method of making an ink pen refill, including the steps of:

a) providig a refill having an elongated barrel having an axis of elongation to which is attached a writing point, said barrel having an ink reservoir fluidly connected to said writing point;

b) dispensing a first layer of ink into said reservoir;

c) dispensing a second layer of ink into said reservoir, said layers being axially aligned; and d) said first and second layers of ink having diverse colors or patterns.

24. The method of claim 23, further including the step of maintaining a dividing line between said layers of ink.

25. An ink pen refill, comprising:

a) an elongated barrel having an axis of elongation;

b) writing point means attached to said barrel for dispensing ink;

c) said elongated barrel having ink reservoir means for storing ink;

d) said ink reservoir means being fluidly connected to said writing point means, said writing point means receiving ink from said ink reservoir means and said writing point means being adapted to dispense said ink;

e) said ink being contained within said ink reservoir means in a plurality of axially aligned regions of ink, each region having a distinct single color or a pattern caused by mixing of plural colors within a said layer.

* * * * *